United States Patent [19]

Butcher

[11] 4,208,818

[45] Jun. 24, 1980

[54] DISPLAY DEVICE

[75] Inventor: Barry T. Butcher, Toronto, Canada

[73] Assignee: Loblaws Limited, Toronto, Canada

[21] Appl. No.: 885,919

[22] Filed: Mar. 13, 1978

[30] Foreign Application Priority Data

Mar. 1, 1977 [CA] Canada ..... 272919

[51] Int. Cl.[2] ..... G09F 3/20

[52] U.S. Cl. ..... 40/16.2; 40/124.1; 40/610; 211/184

[58] Field of Search ..... 40/124.1, 16, 16.2, 40/16.4, 10 R, 584, 606, 610; 248/222.4, 223.1, 223.2, 225.1; 211/184; 108/60, 61

[56] References Cited

U.S. PATENT DOCUMENTS

| | | | |
|---|---|---|---|
| 1,317,589 | 9/1919 | Noziska | 211/184 |
| 1,322,791 | 11/1919 | Hormes | 211/184 X |
| 1,450,191 | 4/1923 | Sturm | 211/184 UX |
| 1,736,574 | 11/1929 | Binks | 211/184 X |
| 2,720,044 | 10/1955 | Montalto | 40/16 |
| 3,077,686 | 2/1963 | Montalto | 40/16 X |
| 3,285,429 | 11/1966 | Probst | 211/184 |
| 3,300,057 | 1/1967 | Wheaton | 211/184 |
| 3,711,977 | 1/1973 | Blankenhorn | 40/124.1 |

*Primary Examiner*—John F. Pitrelli
*Assistant Examiner*—G. Lee Skillington
*Attorney, Agent, or Firm*—Rogers, Bereskin & Parr

[57] ABSTRACT

A display device for displaying two similar articles on a store shelf. The display device has a base portion which includes a flat sheet adapted to overlie a shelf generally horizontally and to have products placed thereof, and a flexible sign holder connected to the front of the flat sheet and extending forwardly and downwardly therefrom for containing pricing information. The display device also includes a thin flag portion connected to the base, the flap portion extending vertically and in a front to rear direction and bisecting the base portion. The flap portion has a vertical flag located forwardly of the flat sheet for increased visibility of the display device from the side thereof.

4 Claims, 3 Drawing Figures

DISPLAY DEVICE

This invention relates to a display device for displaying and comparing articles, and the comparative prices of such articles, on the shelves of supermarkets and other stores.

It is sometimes desired to display similar articles, of different brands, side by side so that a shopper can compare the brands and their prices and select his or her preference. When such a display is presented, it is usually also desired to call particular attention to such display. The normal method of creating such a display is to place a sign on the store shelves near the articles being displayed. The sign normally faces frontwardly into the aisle and can be seen only by shoppers near the display.

Other display devices have been employed having flags which project cross-wise of the aisle, so that they can be seen by a shopper looking in a direction parallel to the shelves. However, such display devices have in the past always been attached to pricing channels which run along the fronts of the store shelves. Therefore, such devices cannot be used on shelves which are not specially equipped with pricing channels. In addition, because they are located at the level of the shelf itself, it is not always clear whether the advertisement on the display device refers to the article on the shelf or to the articles on the shelf below.

Accordingly, it is an object of the present invention to provide a display device for comparatively displaying two articles, which can be seen by a shopper looking in a direction parallel to the shelves, and on which the pricing information more clearly indicates the articles to which the pricing information relates, and yet which interferes to a minimum extent with movement of articles onto or off the shelves. To this end, the present invention provides, in a preferred embodiment, a display device having a base portion which includes a flat sheet adapted to overlie a shelf generally horizontally and to have products placed thereof, and a flexible sign holder connected to the front of the flat sheet and extending forwardly and downwardly therefrom for containing pricing information. The display device also includes a thin flag portion connected to the base, the flag portion extending vertically and in a front to rear direction and bisecting the base portion. The flag portion has a vertical flag located forwardly of the flat sheet for increased visibility of the display device from the side thereof.

Further objects and advantages of the invention will appear from the following description, taken together with the accompanying drawings, in which.

Figures 1, 2, 3:
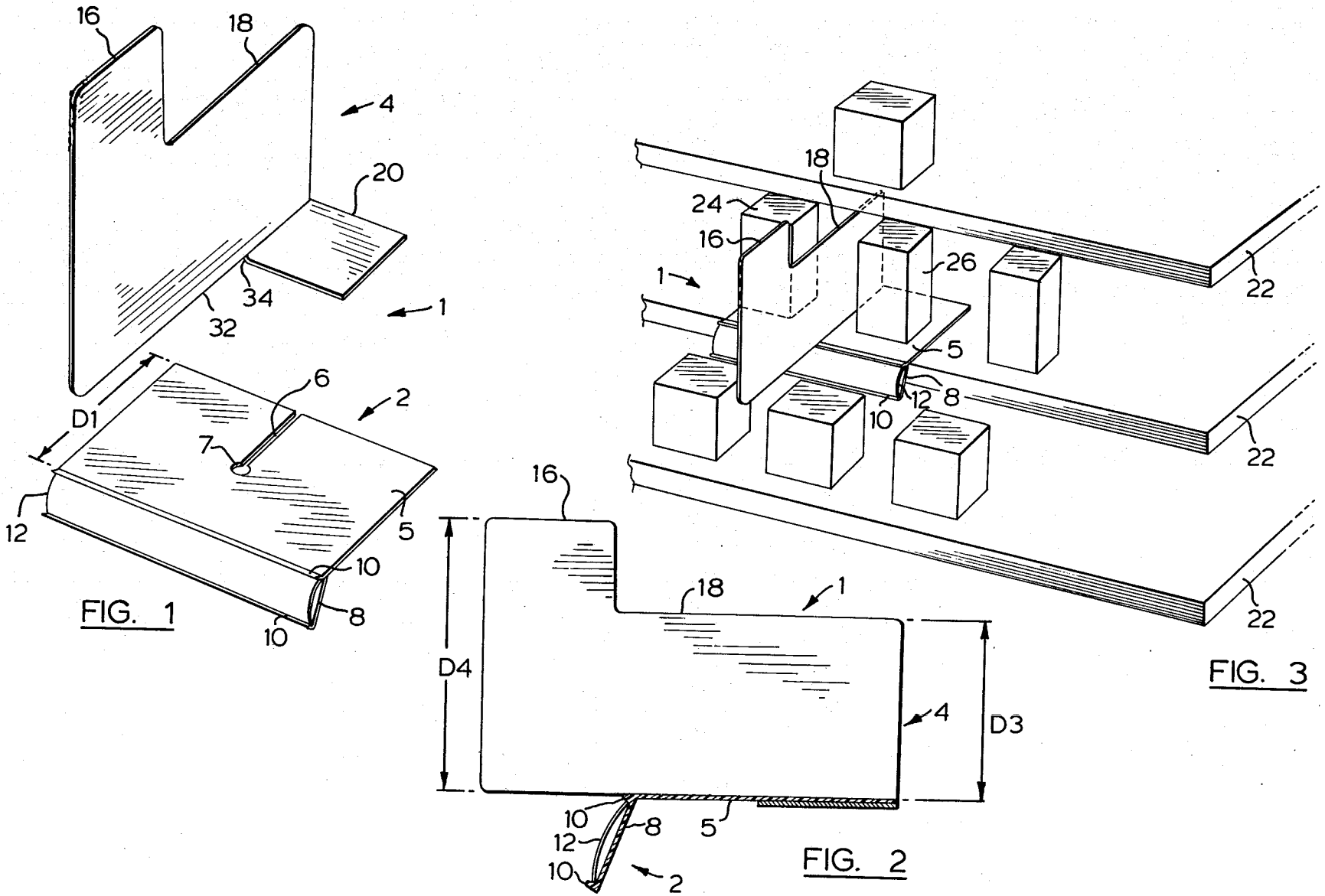
FIG. 1 is an exploded view of a sign holder according to the invention.
FIG. 2 is a side view, partly in section, of the sign holder of FIG. 1 in assembled condition.
FIG. 3 is a perspective view of a set of store shelves containing a display device according to the invention.

Reference is now made to the drawings, which show a display device 1 according to the invention. The display device 1 typically is made in two parts, namely a base 2 and a flag portion 4. Both are typically made of plastic, for example polystyrene.

The base 2 includes a flat sheet 5 which in use lies in a generally horizontal orientation over a shelf on which the display device is placed. The sheet 5 is bisected by a slot 6 which extends forwardly from the rear edge of the sheet 5 approximately midway toward the front of the sheet 5 and which ends in a circular cutout 7. Connected to the front of the sheet 5 is a forwardly and downwardly sloping sign holder 8. The sign holder 8 includes upper and lower forwardly projecting ridges 10 so that a curved sign 12 containing pricing information can be inserted in the sign holder.

The flag portion 4 includes a tall vertical front flag 16, a lower rear divider 18, both extending vertically, and a right angle flag 20 extending from the bottom of the rear divider 18. As shown in FIG. 2, the length of the rear divider 18 is slightly greater than the front to rear depth of the flat sheet 5.

The display device 1 is assembled by inserting the flag 20 through the slot 6 so that the flag portion 4 projects vertically from the base 2, with the flat 20 underlying the sheet 5, as shown in FIGS. 2 and 3. The flag portion 4 now extends in a front to rear direction and projects forwardly of the base 2. The device is next placed on a shelf 22, as shown in FIG. 3, with the flat sheet 5 overlying the shelf and with the flag 16 projecting forwardly of the shelf. Two similar articles, for example a nationally advertised brand article 24 and the store private label brand article 26, may then be placed on the sheet 5, one on each side of the rear divider 18. Price signs 12 may be inserted one in front of each article 24, 26 containing prices for the nationally advertised brand and for the private label brand. The flag 16 may contain eye-catching words such as "compare and save", so that the shopper will be invited to look at the display and compare the two prices. The shopper may then choose either the private brand to save money or the national brand if that is felt to represent a more known quality.

It will be seen that the rear divider 18 of the flag portion 14 is made quite low, so that the display device 1 can be inserted on any shelf, from a low shelf to a high shelf. Since supermarkets and other stores have a wide range of shelf heights, this facilitates use of a single size display device on a variety of shelves. At the same time, the flag 16 is high enough to contain a prominent display of desired advertising material. The tall flag 16 therefore acts readily to catch shoppers' eye. However, because the entire flag portion 4 is oriented vertically and in a front to rear direction, and is very thin, it does not interfere with movement of articles onto and off the shelf. In addition, because the flag portion 4 is centered on the base 2, it allows equal space on each side of the unit so that the national brand article and the private brand article can be equally displayed.

A further important feature of the display device 1 is that the sign holder 8 is flexible (typically it is made of very thin plastic) and slopes forwardly as well as downwardly. Thus, when a shopper removes an article from the shelf below the display device, and if the shopper hits the sign holder during this removal, the sign holder 8 will flex and yield and will not cause injury, nor will it cause displacement of the display device. Typically the angle between the sign holder 8 and the flat sheet 5 is about 120 degrees (i.e. the sign holder 8 has a 30 degree forward slope from the vertical). However, the angle may vary to some extent so long as there is a substantial forward slope, but not so great that the pricing information cannot be read by a shopper standing in front of the display device.

For economic manufacture, it is preferred to produce the display device in two pieces, as shown. In the two piece embodiment the flap 20 at the rear of the flag portion 4 constitutes a counterweight, so that the unit will be stable on the shelf and will not tip over even when the products which normally rests on the flat sheet 5 are removed. However, if desired the flag 4 and base 2 could be made as a single unit, or they could be made as three or more pieces which fit together.

in a preferred embodiment of the invention, the base portion 4 was formed of 0.040 inch thick polystyrene, and the flag portion 2 was formd of 0.060 inch polystyrene. The front to rear depth D1 of the flat sheet 5 was 6 inches; the height D3 of the rear divided 18 was approximately 5 inches, and the height D4 of the front flag was approximately 7½ inches. It was found that these dimensions were particularly capable of adapting to a wide variety of shelf sizes, that the height of the sign holder 10 was sufficient to display pricing information prominently, and that because of the forwardly projecting angle of the sign holder, the device offered an acceptably low level of interference with removal of products from shelves below the display device.

in addition in the preferred embodiment, the upper surface of the flap 20 was located slightly below the bottom edge 32 of the remainder of the flag portion 4, due to a curve 34 in the flap 20 as it joined the rear divider 18. This spacing provides some room for the thickness of the flat sheet 5 of the base. The circular cutout 7 also provided room for the thin material used so that the material could bend as the pieces were fitted together.

What I claim as my invention is:

1. A display device for displaying two or more articles on a store shelf, comprising:

(1) a base portion including;

(a) a flat sheet having a lower surface adapted to overlie said shelf in a generally horizontal position and having an upper surface adapted to have said products placed thereon, (b) a sign holder of flexible plastic material connected to the front of said flat sheet, said sign holder extending forwardly and downwardly from said flat sheet when said flat sheet is in a horizontal position, (c) said sign holder including means for retaining and displaying a pricing display thereon, (2) and a flag portion connected to said base, said flag portion extending in a front to rear direction and bisecting said base, said flag portion being of thin flexible plastic material and extending vertically upwardly from said base when said base is in horizontal position, said flag portion having a rear divider part having an upper edge, said flag portion also having a front flag part, said entire front flag part being located forwardly of said flat sheet and said front flag part extending substantially above said upper edge of said rear divider part, for increased visibility from the side thereof, (3) said entire front flag part being located above the level of said lower surface of said base, so that said front flag part will not interfere with movement of products onto or off a shelf located below said first mentioned shelf.

2. A display device according to claim 1 wherein said flag portion and said base portion are two discrete members, said base portion having a front to rear slot extending forwardly from the rear edge of said flat sheet, said flag portion having a flap extending sideways from said rear divider part thereof, said flap being adapted to fit through said slot beneath said flat sheet.

3. A display device according to claim 1 wherein the angle between said sign holder and said flat sheet is approximately 120 degrees.

4. In a store shelving system having at least three shelves for supporting articles to be displayed, namely a lower, a middle and an upper shelf, a display device on said middle shelf for displaying two or more articles in said middle shelf, said display device comprising:

(1) a base portion including;

(a) a flat sheet overlying said middle shelf in a generally horizontal position and having an upper surface adapted to have said products placed thereon, (b) a sign holder of flexible plastic material connected to the front of said flat sheet, said sign holder extending forwardly and downwardly from said flat sheet, (c) said sign holder including means for retaining and displaying a pricing display thereon, (2) and a flag portion connected to said base, said flag portion extending in a front to rear direction and bisecting said base, said flag portion being of thin flexible plastic material and extending vertically upwardly from said base, said flag portion having a rear divider part havng an upper edge, said flag portion also having a front flag part, said entire front flag part being located forwardly of said middle shelf sheet and said front flag part extending substantially above said upper edge of said rear divider part, for increased visibility from the side thereof, (3) said entire front flag part being located above the level of said lower surface of said base and thereby being located above the level of said middle shelf, so that said flag part will not interfere with movement of products onto or off said lower shelf.

* * * * *